US009103062B2

(12) United States Patent
Welch

(10) Patent No.: US 9,103,062 B2
(45) Date of Patent: Aug. 11, 2015

(54) APPLIANCE WITH FEATURES FOR PREVENTING ADDITIVE DRYING

(75) Inventor: Aaron Lee Welch, Louisville, KY (US)

(73) Assignee: General Electric Company, Schenectady, NY (US)

( * ) Notice: Subject to any disclaimer, the term of this patent is extended or adjusted under 35 U.S.C. 154(b) by 501 days.

(21) Appl. No.: 13/355,719

(22) Filed: Jan. 23, 2012

(65) Prior Publication Data

US 2013/0186151 A1 Jul. 25, 2013

(51) Int. Cl.
*D06F 39/02* (2006.01)

(52) U.S. Cl.
CPC ..... *D06F 39/022* (2013.01); *D06F 39/02* (2013.01)

(58) Field of Classification Search
CPC ..... D06F 39/02; D06F 39/022
USPC ..... 68/13 R, 17 R
See application file for complete search history.

(56) References Cited

U.S. PATENT DOCUMENTS

| | | | | |
|---|---|---|---|---|
| 7,555,923 | B2 | 7/2009 | Kim et al. | |
| 2008/0040871 | A1 | 2/2008 | Wong et al. | |
| 2009/0100881 | A1* | 4/2009 | Dahlke | 68/17 R |
| 2010/0000269 | A1* | 1/2010 | Shin et al. | 68/5 C |
| 2010/0088828 | A1* | 4/2010 | Kim et al. | 8/159 |

* cited by examiner

*Primary Examiner* — Michael Barr
*Assistant Examiner* — Levon J Shahinian
(74) *Attorney, Agent, or Firm* — Dority & Manning, P.A.

(57) ABSTRACT

An appliance is provided with features for preventing fluid additive drying in a conduit of the appliance. The appliance includes a tip configured for receipt of a cover fluid. The cover fluid is disposed within the tip such that the cover fluid deters evaporation of fluid additive in the conduit.

14 Claims, 4 Drawing Sheets

APPLIANCE WITH FEATURES FOR PREVENTING ADDITIVE DRYING

FIELD OF THE INVENTION

The present subject matter is directed to an appliance with features for preventing additive drying in the appliance, e.g., in a conduit or outlet of the appliance that provides additive for a wash or rinse.

BACKGROUND OF THE INVENTION

During particular cycles, a fluid additive can be added to washing fluid being used to clean articles disposed in an appliance such as a washing machine. The fluid additive can be, e.g., a fabric softener, bleach, or detergent. In certain washing machine appliances, a user can fill a reservoir with fluid additive when the user is starting the appliance. Alternatively, certain washing machine appliances include a bulk fluid additive dispensing system with a reservoir having a volume of fluid additive sufficient for a plurality of wash cycles of the appliance. Regardless, the appliance's reservoir is connected to a conduit that directs the fluid additive to a wash chamber of the appliance at a designated time. In the wash chamber, the fluid additive mixes with the wash fluid, e.g., to soften fabric or clean articles.

Fluid additive exits the conduit and enters the wash chamber at an outlet. Over time, the outlet and/or conduit can clog or become obstructed by fluid additive. For example, when fluid additive disposed on a surface is exposed to air, the fluid additive dries. When the fluid additive dries, a film can be left on the surface. Over time, the film can grow to a size sufficient to clog or obstruct the outlet and/or conduit. This is particularly true for bulk dispensing systems where fluid additive can be stored in the conduit and/or outlet for extended periods of time. When clogged, the outlet or conduit cannot permit a flow of fluid additive. Thus, fluid additive can be prohibited from entering the wash chamber by a clog or obstruction created by drying of the fluid additive.

In order for the washing machine appliance to function properly, the outlet and conduit should remain free of clogs and/or obstructions. Such clogs and obstructions can require a service call by a maintenance technician in order to repair the appliance. Such service calls can be expensive and time consuming.

Previously, in order to prevent clogging of the conduit and/or the outlet, a one-way or check valve was installed within the conduit, e.g., adjacent the outlet, in order to limit the flow of fluid additive. However, such valves can seal in a manner similar to that described above. For example, over time, fluid additive may leave residue that can build until the residue blocks the flow of fluid additive through the valve or the residue can seal the valve shut.

Accordingly, a washing machine appliance with features for preventing clogging or obstructing of a conduit and/or outlet would useful. More particularly, a washing machine appliance with features for preventing fluid additive from drying within the conduit and/or outlet would useful. In addition, a washing machine appliance that prevents clogging or obstructing of a conduit and/or outlet without use of a valve would also be useful.

BRIEF DESCRIPTION OF THE INVENTION

Aspects and advantages of the invention will be set forth in part in the following description, or may be obvious from the description, or may be learned through practice of the invention.

In a first embodiment, a washing machine appliance is provided. The washing machine appliance includes a cabinet and a wash tub received in the cabinet. The wash tub is configured for containing a washing fluid used in a washing process. The wash tub also defines a wash chamber. The washing machine also includes a conduit configured for containing a fluid additive. The conduit extends between an inlet and an outlet. The inlet of the conduit is configured for receiving the fluid additive. A tip extends between the outlet of the conduit and the wash tub. An entrance of the tip is positioned adjacent the outlet of the conduit and configured for receipt of fluid additive from the conduit. An exit of the tip is positioned adjacent the wash tub. The entrance of the tip is disposed lower than the exit of the tip. The tip is configured for receiving a cover fluid during operation of the washing machine appliance in order to deter evaporation of fluid additive in the conduit.

In a second embodiment, an appliance is provided. The appliance includes a cabinet having a wash chamber containing an atmosphere. A conduit is configured for directing a flow of a fluid additive to the wash chamber of the cabinet. A tip is positioned adjacent the wash chamber of the cabinet. The tip is in fluid communication with the wash chamber of the cabinet and the conduit. The tip defines a reservoir configured for receipt of a cover fluid such that the cover fluid of the reservoir is disposed between the fluid additive of the conduit from the atmosphere of the cabinet.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
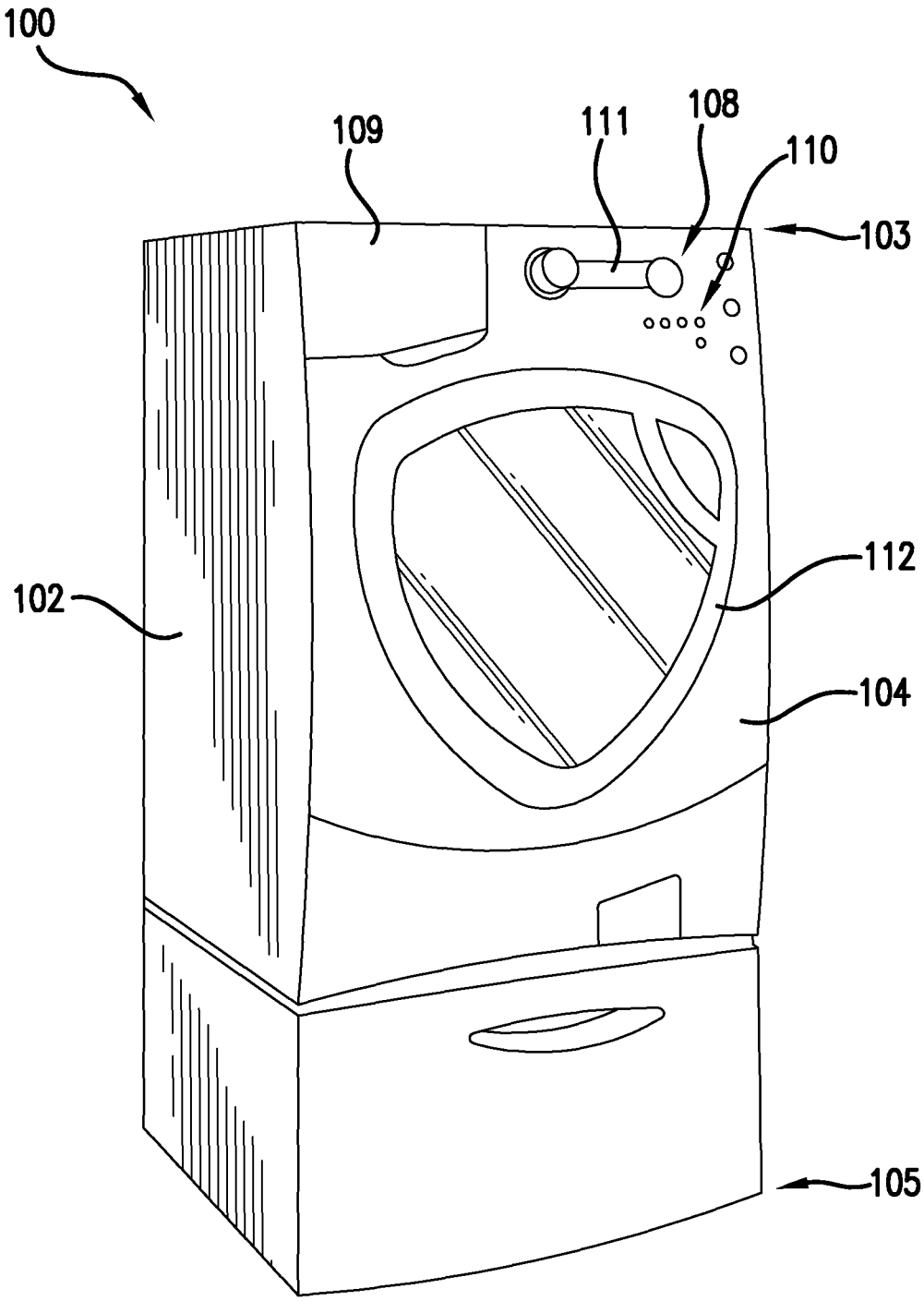
FIG. 1 provides a perspective view of a washing machine appliance according to an exemplary embodiment of the present subject matter.

An appliance is provided with features for preventing fluid additive drying in a conduit of the appliance. The appliance includes a tip configured for receipt of a cover fluid. The cover fluid is disposed within the tip such that the cover fluid deters evaporation of fluid additive in the conduit. Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
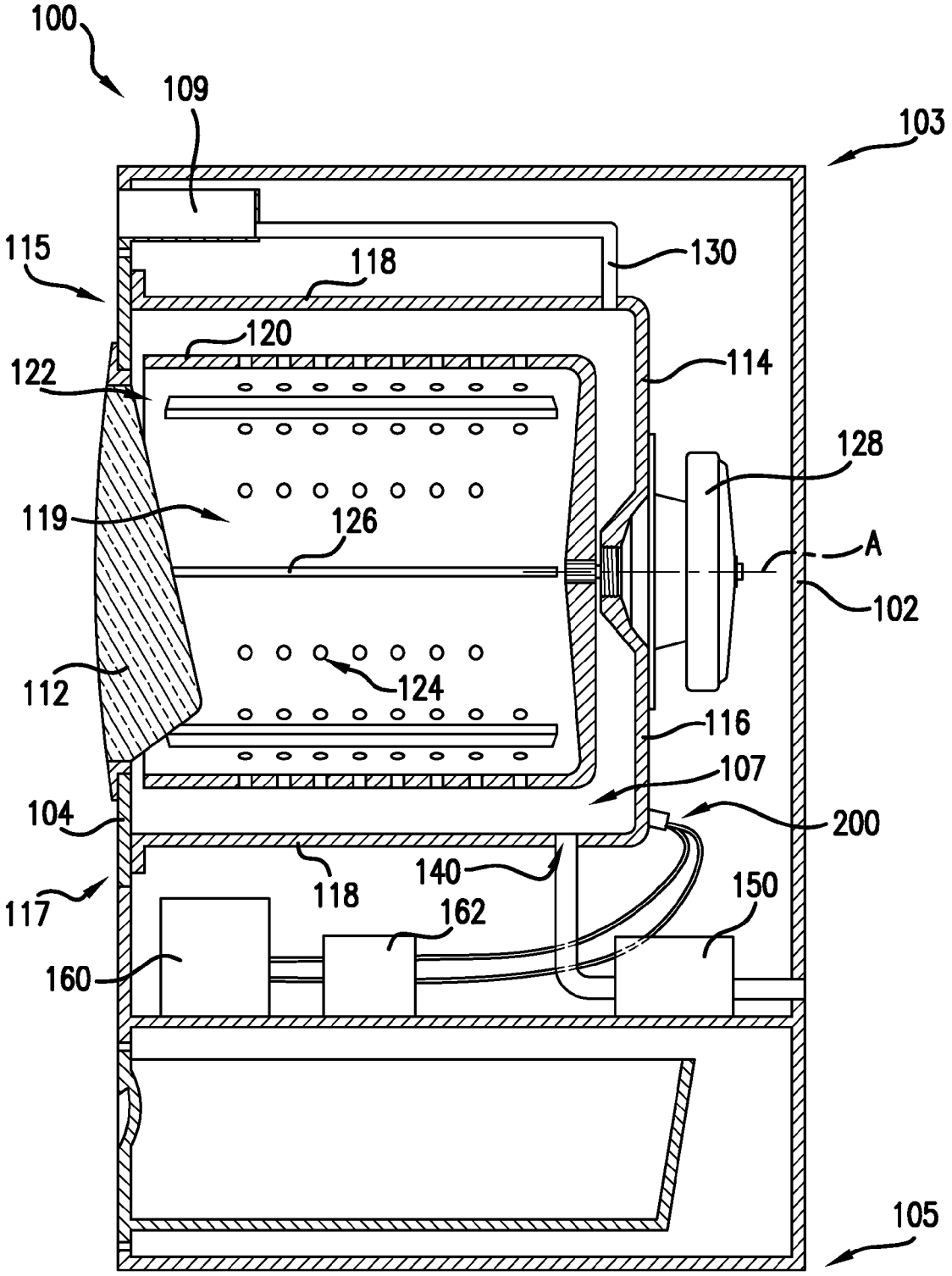
FIG. 2 is a side cross-sectional view of the exemplary washing machine appliance of FIG. 1.

FIG. 1 is a perspective view of an exemplary horizontal axis washing machine 100 having a cabinet 102. FIG. 2 is a side cross-sectional view of washing machine appliance 100. Cabinet 102 extends between a top 103 and a bottom 105. Cabinet also includes a front panel 104. A door 112 is mounted to front panel 104 and is rotatable about a hinge (not shown) between an open position (not shown) facilitating access to a wash tub 114 (FIG. 2) located within cabinet 102, and a closed position (FIG. 1) prohibiting access to wash tub 114.

A control panel 108 including a plurality of input selectors 110 is coupled to front panel 104. Control panel 108 and input selectors 110 collectively form a user interface input for operator selection of machine cycles and features. For example, in one embodiment, a display 111 indicates selected features, a countdown timer, and/or other items of interest to machine users.

Referring now to FIG. 2, wash tub 114 defines a wash chamber 119 configured for receipt of a washing fluid. Thus, wash tub 114 is configured for containing washing fluid. Washing fluid disposed in wash tub 114 may include, e.g., water, fabric softener, bleach, and/or detergent. Wash tub 114 includes a back wall 116 and a sidewall 118 and also extends between a top 115 and a bottom 117. A pump assembly 150 is located beneath tub 114 for gravity assisted flow when draining tub 114. Pump assembly 150 is also configured for recirculating washing fluid within wash tub 114.

A basket 120 is rotatably mounted within wash tub 114 in a spaced apart relationship from tub sidewall 118 and the tub back wall 116. Basket 120 defines an opening 122 for receiving for washing. Basket also 120 defines a plurality of perforations 124 in order to facilitate fluid communication between an interior of basket 120 and wash tub 114. A sump 107 is defined by wash tub 114 and is configured for receipt of washing fluid during operation of appliance 100. For example, during operation of appliance 100, washing fluid may be urged by gravity from basket 120 to sump 107 through plurality of perforations 124.

A spout 130 is configured for directing a flow of fluid into wash tub 114. Spout 130 may be in fluid communication with a water supply (not shown) in order to direct fluid (e.g., clean water) into wash tub 114. Spout 130 may also be in fluid communication with the sump 107. For example, pump assembly 150 may direct washing fluid disposed in sump 107 to spout 130 in order to circulate washing fluid in wash tub 114.

A motor 128 is in mechanical communication with basket 120 in order to selectively rotate basket 120, e.g., during an agitation or a rinse cycle of washing machine appliance 100 as described below. Ribs 126 extend from basket 120 into wash chamber 119. Ribs 126 assist agitation of articles disposed within wash chamber 119 during operation of washing machine appliance 100. For example, ribs 126 may lift articles disposed in basket 120 during rotation of basket 120.

A drawer 109 is slidably mounted within front panel 104. Drawer 109 receives a fluid additive (e.g., detergent, fabric softener, bleach, or any other suitable liquid) and directs the fluid additive to wash chamber 119 during operation of appliance 100. Additionally, a reservoir 160 is disposed within cabinet 102. Reservoir 160 is also configured for receipt of fluid additive for use during operation of washing machine appliance 100 (shown in FIG. 1). Reservoir 160 is sized such that a volume of fluid additive sufficient for a plurality or multitude of wash cycles of appliance 100 (e.g., five, ten, twenty, fifty, or any other suitable number of wash cycles) may fill reservoir 160. Thus, for example, a user can fill reservoir 160 with fluid additive and operate appliance 100 for a plurality of wash cycles without refilling reservoir 160 with fluid additive. A reservoir pump 162 is configured for selective delivery of the fluid additive from reservoir 160 to wash tub 114.

Operation of washing machine appliance 100 is controlled by a controller or processing device (not shown), that is operatively coupled to control panel 108 (FIG. 1) for user manipulation to select washing machine cycles and features. In response to user manipulation of control panel 108, the controller operates the various components of washing machine appliance 100 to execute selected machine cycles and features.

In an illustrative embodiment, laundry items are loaded into wash basket 120, and washing operation is initiated through operator manipulation of input selectors 110. Wash tub 114 is filled with water and detergent to form a wash fluid. One or more valves (not shown) can be controlled by washing machine appliance 100 to provide for filling wash tub 114 to the appropriate level for the amount of articles being washed. Once wash tub 114 is properly filled with fluid, the contents of wash basket 120 are agitated with ribs 126 for cleansing of laundry items in basket 120.

After the agitation phase of the wash cycle is completed, wash tub 114 is drained. Laundry articles can then be rinsed by again adding fluid to wash tub 114, depending on the particulars of the cleaning cycle selected by a user, ribs 126 may again provide agitation within wash chamber 119. One or more spin cycles may also be used. In particular, a spin cycle may be applied after the wash cycle and/or after the rinse cycle in order to wring wash fluid from the articles being washed. During a spin cycle, basket 120 is rotated at relatively high speeds.

While described in the context of a specific embodiment of horizontal axis washing machine appliance 100, using the teachings disclosed herein it will be understood that horizontal axis washing machine appliance 100 is provided by way of example only. Other washing machine appliances having different configurations, different appearances, and/or different features may also be utilized with the present subject matter as well, e.g., vertical axis washing machine appliances. In addition, the teachings disclosed herein may be used with other appliances as well, e.g., a dishwasher appliance.

Figure 3:
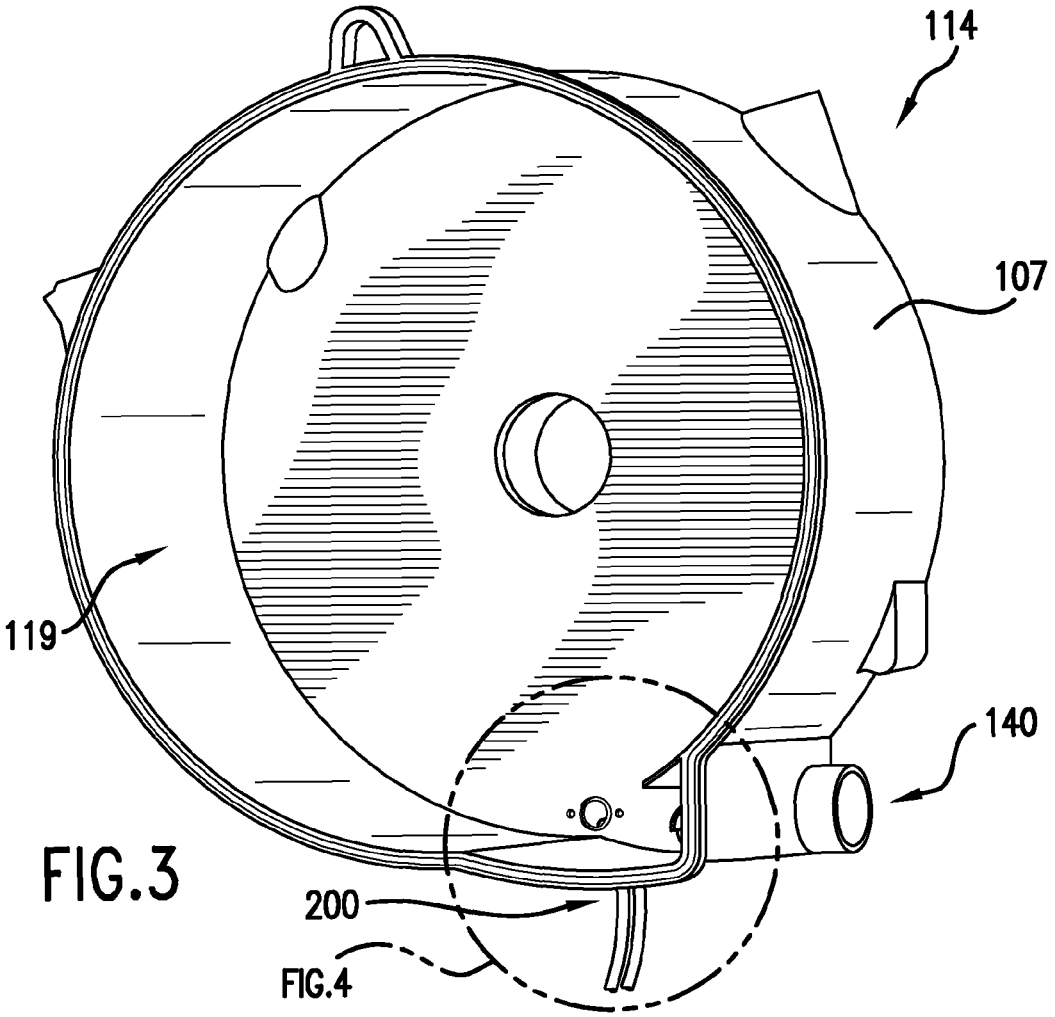
FIG. 3 illustrates a perspective view of a wash tub of the washing machine appliance of FIG. 1.
Figure 4:
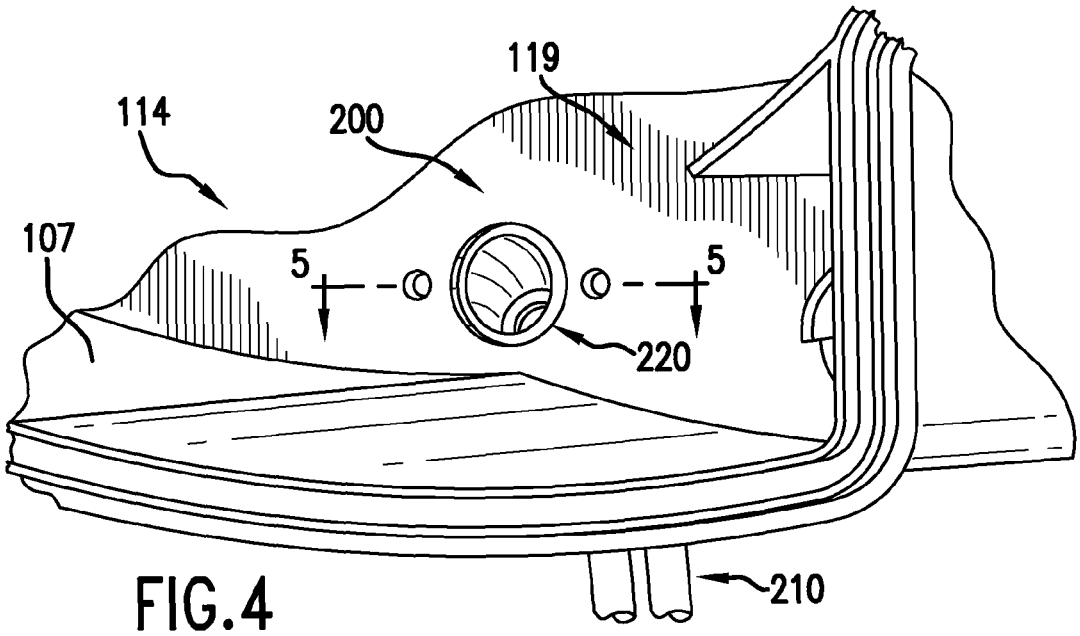
FIG. 4 provides a perspective view of a portion of the wash tub of FIG. 2 and particularly illustrates an exemplary tip of a fluid additive system.

FIG. 3 illustrates a perspective view of the wash tub 114 including sump 107 of washing machine appliance 100. FIG. 4 provides a perspective view of a portion of tub 114 with sump 107 and particularly illustrates a fluid additive system 200 of washing machine appliance 100. Fluid additive system 200 includes a conduit 210 (here shown as a pair of hoses or tubes) and a well or tip 220.

Conduit 210 is configured for receipt of a fluid additive, e.g., from drawer 109 or reservoir 160. For example, a user may add fluid additive to drawer 109, and the fluid additive may be urged by gravity into conduit 210. Alternatively, reservoir pump 162 may be in fluid communication with conduit 210 such that reservoir pump 162 may urge fluid additive from reservoir 160 into conduit 210.

Upon receipt of fluid additive, conduit 210 is configured for directing a flow of fluid additive to tip 220. Thus, tip 220 receives fluid additive from conduit 210 and directs flow of fluid additive to wash chamber 119 of wash tub 114. Accordingly, tip 220 is in fluid communication with conduit 210 and wash tub 114 in order to direct fluid additive into wash tub 114.

As may be seen in FIG. 4, tip 220 has a substantially circular cross-section. However, in alternative embodiments, the cross-section of tip 220 may have any suitable shape, e.g., oval or rectangular. Also, in FIG. 3, tip 220 is shown disposed in sump 107 adjacent a drain 140. In alternative embodiments, tip 220 may be disposed at any suitable location in washing machine appliance 100. For example, tip 220 may be disposed below spout 130, positioned adjacent top 115 of wash tub 114, or positioned adjacent bottom 117 of wash tub 114 (all shown in FIG. 2).

Figure 5:
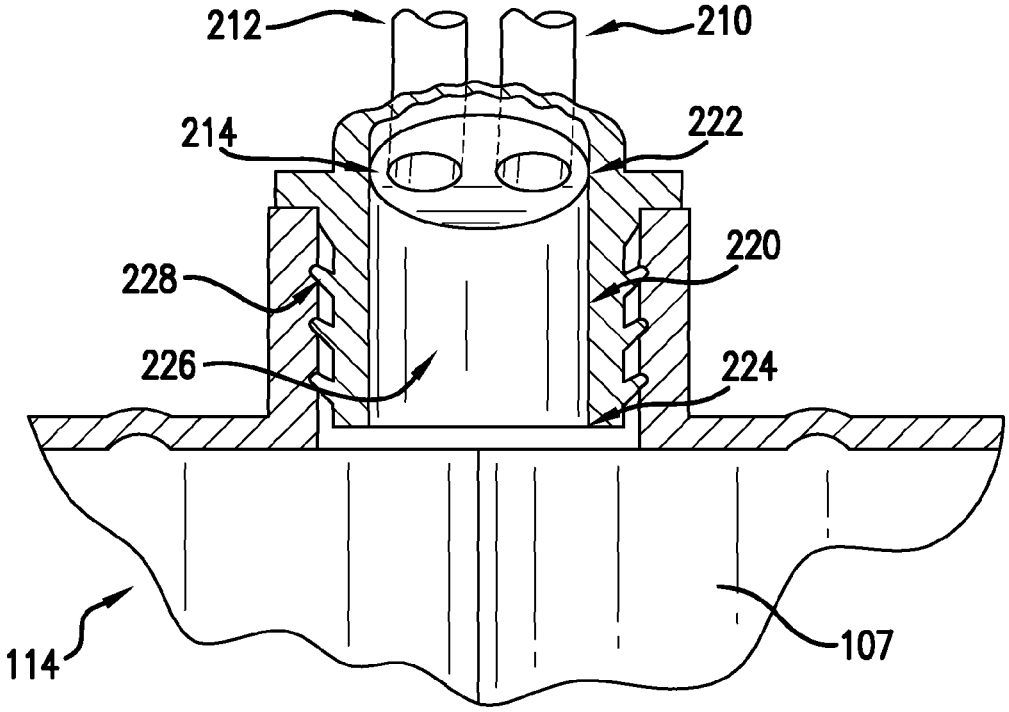
FIG. 5 is a top cross-sectional view of the exemplary tip of the fluid additive system of FIG. 4 taken along the 5-5 axis.
Figure 6:
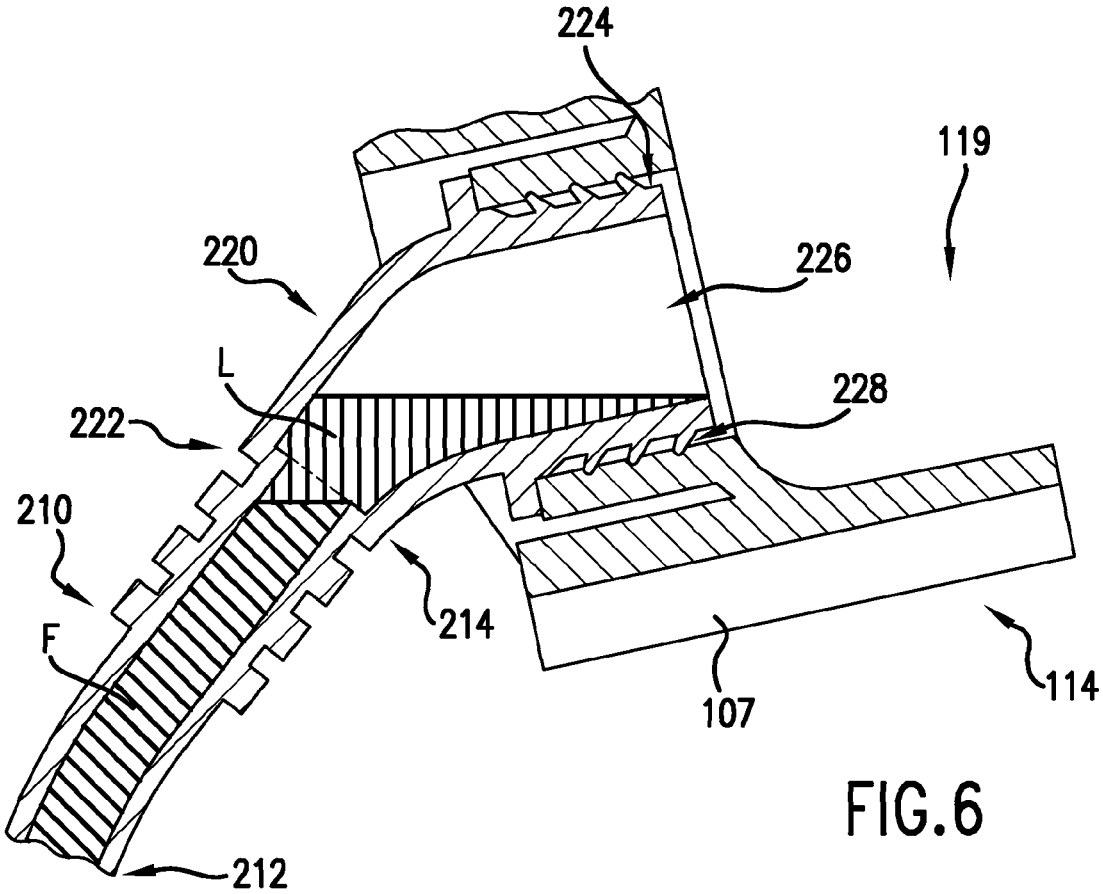
FIG. 6 is a side cross-sectional view of the exemplary tip of the fluid additive system of FIG. 4.

FIG. 5 illustrates a top cross-sectional view of tip 220 and conduit 210. FIG. 6 is a side cross-sectional view of tip 220 and conduit 210. Conduit 210 extends between an inlet 212 and an outlet 214. Inlet 212 is configured for receipt of fluid additive. Inlet 212 may be positioned at any suitable location in washing machine appliance 100. For example, inlet 212 may be positioned adjacent a top 103 of cabinet 102 in order to permit gravity assisted feeding of fluid additive from drawer 109. In an alternative embodiment, inlet 212 may be positioned adjacent reservoir 160 in order to permit reservoir pump 162 to urge fluid additive from reservoir 160 into conduit 210.

Outlet 214 is positioned adjacent tip 220. Thus, fluid additive exiting conduit 210 at outlet 214 enters tip 220. As may be seen in FIG. 5, conduit 210 may include a pair of hoses. Each of the pair of hoses may direct a particular fluid additive to tip 220. Conduit 210 may be a pipe, tube, or any other suitable conduit. Also, conduit 210 may have a single hose or any other suitable number of hoses or conduits.

Tip 220 extends between an entrance 222 and an exit 224. Entrance 222 of tip 220 receives fluid additive from conduit 210 and is positioned adjacent outlet 214 of conduit 210. Exit 224 of tip 220 is positioned adjacent wash tub 214. Between entrance 222 and exit 224, tip 220 defines a reservoir 226 configured for receiving fluid additive from conduit 210 and a cover fluid L (shown in FIG. 6) as described in greater detail below. During operation of appliance 100, tip 220 receives cover fluid L in order to deter evaporation of fluid additive in conduit 210. As may be seen in FIG. 5, tip 220 may have threads 228 that are received by wash tub 114 in order to secure tip 220 to wash tub 228. Thus, tip 220 may screw into wash tub 114. In alternative embodiments, tip 220 may be secured to wash tub 228 using any suitable mechanism.

As discussed above, tip 220 has a circular cross-section. In FIG. 6, tip 220 has a first cross-sectional area adjacent entrance 222 of tip 220. Also, tip 220 has a second cross-sectional area adjacent exit 224 of tip 220. In FIG. 6, the first cross-sectional area is larger than the second cross-sectional area. Thus, tip 220 has a larger cross-sectional area at exit 224 relative to entrance 222. In various embodiments, the cross-sectional area of exit 224 may be more than about twice as large as the cross-sectional area of entrance 222. In alternative embodiments, the cross-sectional area of exit 224 may be less than about twice as large as the cross-sectional area of entrance 222. However, in additional alternative embodiments, the cross-sectional area of exit 224 may be less than or equal to the cross-sectional area of entrance 222.

As may be seen in FIG. 6, conduit 210 contains fluid additive F. Fluid additive F fills conduit 210 such that fluid additive F is positioned adjacent entrance 222 of tip 220. Fluid additive F may be, e.g., fabric softener, bleach, detergent, or any other fluid suitable for addition to washing fluid in wash tub 114.

In addition, in FIG. 6, tip 220 contains cover fluid L. Cover fluid L is received in reservoir 226 of tip 220. In FIG. 6, cover fluid L is disposed in tip 220 such that cover fluid L extends from entrance 222 of tip 220 to exit 224 of tip 220. As discussed above, tip 220 contains cover fluid L in order to limit evaporation of fluid additive F in conduit 210. Thus, cover fluid L in tip 220 may segregate fluid additive F in conduit 210 from an atmosphere (e.g., air) contained in wash tub 114. By segregating fluid additive F from atmosphere, fluid additive F may remain in liquid form (i.e., not dry out). By limiting evaporation of fluid additive F, cover fluid L may inhibit growth of clogs that would prevent a flow of fluid additive F through conduit 210 and tip 220 into wash tub 114.

To keep cover fluid L in reservoir 226, entrance 222 of tip 220 is positioned lower than exit 224 of tip 220. Thus, cover fluid L may settle over fluid additive F during operation of appliance 100 in order to limit evaporation of fluid additive F in conduit 210. As may be seen in FIG. 6, tip 220 is also angled. Thus, fluid additive flowing through tip 220 changes direction at least once due to tip 220 being angled. Tip 220 can be angled, e.g., in order to keep cover fluid L disposed between atmosphere of wash tub 114 and fluid additive F of conduit 210.

Cover fluid L may be, e.g., water, detergent, water and detergent, water and fluid additive, or any other suitable liquid or combination of liquids. For example, cover fluid L may have a composition that is less than about 90, 80, 70, 60, 50, 40, 30, 20, 10, or 5% fluid additive F. By providing cover fluid with a diluted composition of fluid additive relative to the fluid additive F of conduit 210, the amount of time needed for the cover fluid L to evaporate may be increased relative to concentrated fluid additive F. Also, evaporation of cover fluid L may leave behind less particles (e.g., a film) compared to a comparable volume of fluid additive F. Thus, evaporation of cover fluid L may decrease the buildup of clogs compared to evaporation of fluid additive F.

Cover fluid L may be received in reservoir 226, e.g., during operation of washing machine appliance 100. For example, because tip 220 is disposed in sump 107, during operation of appliance 100, washing fluid (e.g., water and detergent) may settle in reservoir 226 due to gravity and act as cover fluid L. Thus, when tip 220 is disposed in sump 107, tip 220 may passively collect cover fluid L (e.g., washing fluid) during operation of appliance 100. Alternatively, as discussed above, tip 220 may be disposed beneath spout 130 adjacent top 103 of cabinet 102. When spout 130 is adjusted such that water from a water source (not shown) is entering wash tub 114, reservoir 226 may receive water from spout 130 such that the water acts as cover fluid L. Thus, when tip 220 is disposed beneath spout 130 adjacent top 103 of cabinet 102, tip 220 may passively collect cover fluid L (e.g., water) during operation of appliance 100. In additional alternative embodiments, tip 220 may receive cover fluid L in any other suitable manner and may be disposed at any suitable location in appliance 100.

As an example, during a wash cycle of washing machine appliance 100, fluid additive may be added to wash chamber 119 of wash tub 114. Thus, fluid additive may flow through conduit 210 and tip 220 into wash chamber 119. For example, reservoir pump 162 may urge detergent stored in reservoir 160 into wash chamber 119 via conduit 210 and tip 220. However, after pumping the detergent into wash chamber 119, detergent can remain in conduit 210 and tip 220. In wash chamber 119, the fluid additive may mix with washing fluid, e.g., in order to soften or clean fabric articles therein.

After the wash cycle is complete, the articles being washed may be rinsed in order to remove washing fluid from the articles. During the rinse cycle, cover fluid may enter reservoir 226 of tip 220 and settle above fluid additive remaining in conduit 210. After completion of the rinse cycle, the cover fluid remains in the tip 220 disposed atop the fluid additive on the conduit 210. In the tip 220, the cover fluid can assist in limiting evaporation of the fluid additive in conduit 210. The cover fluid can remain disposed atop fluid additive until washing machine appliance 100 is activated and placed in operation at a later time. Thus, cover fluid in tip 220 can assist in preventing clogs in conduit 210 and tip 220 by preventing potential clog growth due to evaporation of fluid additive. However, it should be noted that the above example is not intended to be limiting, and one skilled in the art will appreciate that cover fluid can enter tip 220 via other methods than those described above and be disposed in tip 220 in a manner other than those described above.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance comprising:

a cabinet;

a wash tub received in said cabinet and configured for containing a washing fluid used in a washing process, said wash tub defining a wash chamber having an atmosphere;

a bulk fluid additive tank positioned within said cabinet, said tank configured for containing a fluid additive, said tank sized for containing a volume of fluid additive sufficient for a plurality of cycles of the washing machine appliance;

a conduit configured for directing the fluid additive out of said tank, said conduit extending between an inlet and an outlet, the inlet of said conduit positioned at said tank and configured for receiving the fluid additive;

a pump coupled to said conduit and operable to urge the fluid additive from said tank into said conduit; and a tip extending between the outlet of said conduit and said wash tub, an entrance of said tip being positioned adjacent to the outlet of said conduit and configured for receipt of the fluid additive from said conduit, an exit of said tip being positioned adjacent to said wash tub, the entrance of said tip being disposed lower than the exit of said tip, the entrance of said tip having first cross-sectional area, and the exit of said tip having a second cross-sectional area, the second cross-sectional area more than about twice as large as the first cross-sectional area, said tip configured for receiving a cover fluid during operation of the washing machine appliance in order to deter evaporation of fluid additive in said conduit.

2. The washing machine appliance of claim 1, wherein said tip is positioned adjacent a bottom portion of said wash tub.

3. The washing machine appliance of claim 1, wherein said tip is positioned adjacent a top portion of said wash tub.

4. The washing machine appliance of claim 1, further comprising a spout configured for directing a flow of washing fluid into said wash tub such that at least a portion of said tip is positioned within the flow of washing fluid.

5. The washing machine appliance of claim 1, wherein said conduit comprises a hose.

6. The washing machine appliance of claim 1, wherein washing additive is disposed adjacent the entrance of said tip, and cover fluid is disposed adjacent the exit of said tip.

7. The washing machine appliance of claim 1, wherein said tip is angled in order to produce a change in direction of a flow of fluid additive through said tip.

8. An appliance comprising:

a cabinet having a wash chamber containing an atmosphere;

a bulk fluid additive tank positioned within said cabinet, said tank configured for containing a fluid additive, said tank sized for containing a volume of fluid additive sufficient for a plurality of cycles of the appliance;

a conduit configured for directing a flow of the fluid additive from said tank to the wash chamber of said cabinet;

a pump coupled to said conduit and operable to urge the fluid additive from said tank into said conduit; and a tip positioned adjacent the wash chamber of said cabinet, said tip being in fluid communication with the wash chamber of said cabinet and said conduit, said tip extending between an entrance and an exit, the entrance of said tip being positioned adjacent said conduit, the entrance of said tip having a first cross-sectional area, the exit of said tip having a second cross-sectional area, the second cross-sectional area more than about twice as large as the first cross-sectional area, said tip defining:

a reservoir configured for receipt of a cover fluid such that the cover fluid of said reservoir is disposed between fluid additive disposed in said conduit and the atmosphere of said cabinet.

9. The appliance of claim 8, further comprising a wash tub received in said cabinet and configured for containing a washing fluid used in a washing process, and wherein the appliance comprises a washing machine appliance.

10. The appliance of claim 9, wherein said tip is positioned adjacent a top portion of said wash tub.

11. The appliance of claim 9, wherein said tip is positioned adjacent a bottom portion of said wash tub.

12. The appliance of claim 8, further comprising a spout configured for directing a flow of washing fluid into said wash tub such that at least a portion of said tip is positioned within the flow of washing fluid.

13. The appliance of claim 8, wherein said conduit comprises a hose.

14. The appliance of claim 8, wherein said tip is angled in order to produce a change in direction of the flow of fluid additive through said tip.

* * * * *